US006058972A

United States Patent [19]

Kahle et al.

[11] Patent Number: 6,058,972

[45] Date of Patent: May 9, 2000

[54] MIXING VALVE

[75] Inventors: Dieter Kahle, Iserlohn; Eberhard Stolle, Hagen, both of Germany

[73] Assignee: Friedrich Grohe AG, Hemer, Germany

[21] Appl. No.: 09/255,594

[22] Filed: Feb. 22, 1999

[30] Foreign Application Priority Data

Mar. 12, 1998 [DE] Germany ..... 198 10 699

[51] Int. Cl.[7] ..... F16K 11/06

[52] U.S. Cl. ..... 137/625.4; 137/359

[58] Field of Search ..... 137/359, 625.4, 137/625.41

[56] References Cited

U.S. PATENT DOCUMENTS

| | | | |
|---|---|---|---|
| 5,167,255 | 12/1992 | Gohring et al. | 137/607 |
| 5,660,203 | 8/1997 | Gnauert et al. | 137/359 |
| 5,730,176 | 3/1998 | Heimann et al. | 137/359 |

FOREIGN PATENT DOCUMENTS

| | | |
|---|---|---|
| 31 20 210 | 12/1982 | Germany . |
| 43 12 103 | 10/1994 | Germany . |
| 0 701 028 | 3/1996 | Germany . |

*Primary Examiner*—John Fox
*Attorney, Agent, or Firm*—Herbert Dubno; Andrew Wilford

[57] ABSTRACT

A valve body has a hollow rigid housing formed with at least two outwardly open sockets centered on respective axes that extend generally perpendicularly of each other and a connector body fitted in one of the sockets at an intersection of the axes and having an outer face directed outwardly in the one socket and an inner face directed outward in the other socket. The connector body is also formed with a plurality of passages extending between the faces. A valve cartridge is secured to the connector-body outer face. In addition an insert body fitted in the other socket has an inner face engaging complementarily with the connector-body inner face and is formed with passages having inner ends opening into the connector-body passages at the connector-body inner face and outer ends. One of the inner faces is formed as a recess and the other as a complementary projection such that when fitted together the connector body is fixed in the housing. Input lines are connected to the outer ends of the insert-body passages and a mounting element extends into the insert body for securing the bodies and housing to a plate.

11 Claims, 4 Drawing Sheets

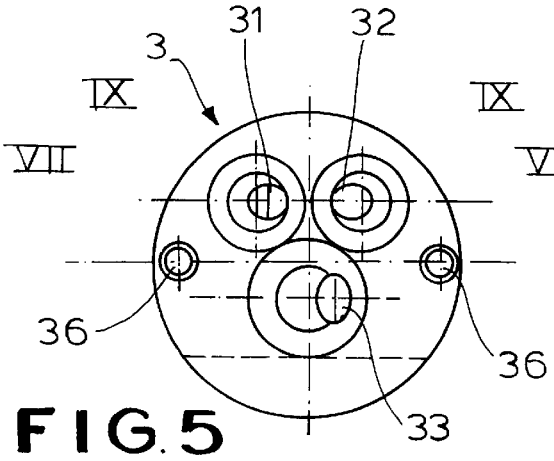
FIG.5
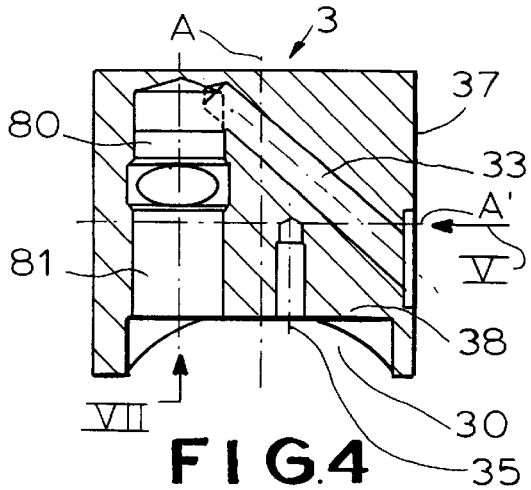
FIG.4
FIG.6
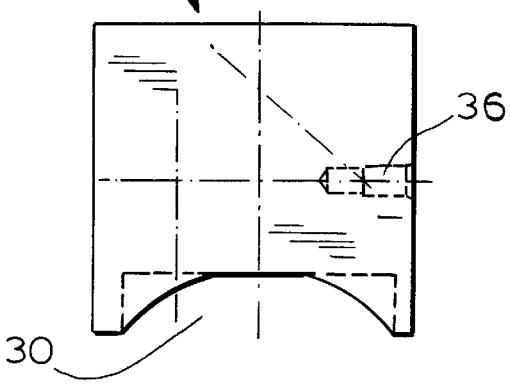
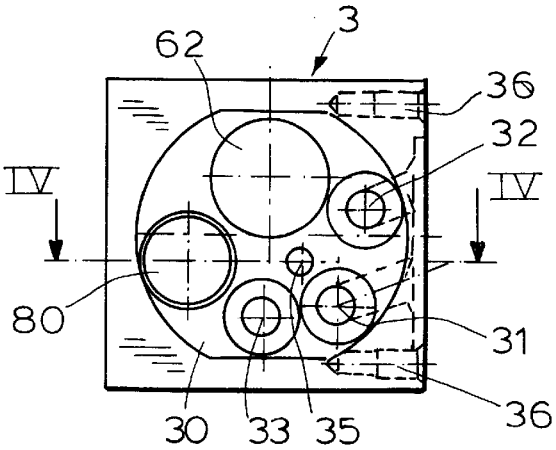
FIG.7
FIG.8
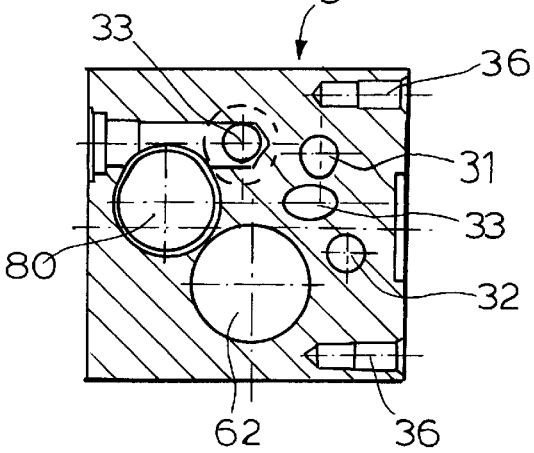
FIG.9
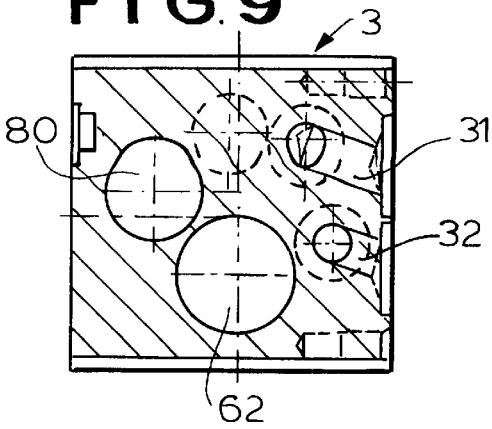

MIXING VALVE

FIELD OF THE INVENTION

The present invention relates to a valve. More particularly this invention concerns such a mixing valve.

BACKGROUND OF THE INVENTION

A standard mixing valve has a housing in which is contained a connector block to which are connected hot- and cold-water input lines and a mixed-water output line and on which is mounted a valve cartridge. A lever or the like connected to the cartridge can move in one direction to vary the volume rate of flow from the input lines to the output line, and in a normally transverse direction to vary the mix ratio between the input lines, thereby controlling output temperature. Typically the housing has a decorative outside finish and is intended to cover and protect the connecting block and valve cartridge. The connecting block itself is normally fixed to some kind of plate, which term is here intended to include a deck, counter, or wall panel, and the housing is in turn fixed to the connector block.

As described in German patent document 3,120,210 filed May 21, 1981 by A. Gottwald, a variation on this system is shown where the valve cartridge is carried at the outer end of an L-shaped housing whose inner end is itself bolted to the deck plate. In this system as in virtually all the prior art, the connection of the housing to the connector block is visible from outside, marring the appearance of the valve and creating a trap for dirt. Furthermore assembly of these system is relatively complex, often entailing connecting several pieces together, then fitting them to the housing, and finally securing the housing in place on the connected pieces.

OBJECTS OF THE INVENTION

It is therefore an object of the present invention to provide an improved valve body.

Another object is the provision of such an improved valve body which overcomes the above-given disadvantages, that is which is extremely easy to assemble and that has a very neat and clean appearance.

SUMMARY OF THE INVENTION

A valve body has according to the invention a hollow rigid housing formed with at least two outwardly open sockets centered on respective axes that extend generally perpendicularly of each other and a connector body fitted in one of the sockets at an intersection of the axes and having an outer face directed outwardly in the one socket and an inner face directed outward in the other socket. The connector body is also formed with a plurality of passages extending between the faces. A valve cartridge is secured to the connector-body outer face. In addition according to the invention an insert body fitted in the other socket has an inner face engaging complementarily with the connector-body inner face and is formed with passages having inner ends opening into the connector-body passages at the connector-body inner face and outer ends. One of the inner faces is formed as a recess and the other as a complementary projection such that when fitted together the connector body is fixed in the housing. Input lines are connected to the outer ends of the insert-body passages and a mounting element extends into the insert body for securing the bodies and housing to a plate.

In accordance with the invention the one socket extends across the axis of the other socket and in fact the other socket extends across the one socket and is outwardly open in two axially opposite directions. Thus when the two bodies are fitted together they not only secure each other in place, but secure themselves relative to the housing, eliminating the need for any further connection between the housing and the bodies.

The mounting element according to the invention extends through the housing and through both of the bodies and is provided with a nut bearing on the housing in one direction and another nut threaded on the mounting element and bearing in an opposite direction on the plate. This mounting element is a pipe and the body includes a flexible feed tube extending through the pipe. The feed tube can be connected at one end through the insert body to the mixed-water passage of the connector body and can carry at its opposite end a head that serves both as the end of a spout and as a movable sprayer.

For best sealing of the housing to the deck, the housing is formed around the pipe with a groove and is provided in the groove with a seal ring bearing against the plate. The housing is normally of steel.

The recess is normally formed according to the invention in the connector-body inner face and a screw extends across the inner faces and has a head bearing on the insert body and a shank threaded in the connector body. Thus installing this one screw not only.

According to the invention an aerator in one of the connector-body passages and may be vented into the hole in the deck where the valve is mounted. The bodies can be of brass or plastic and the tubes can each be provided with a seal ring that is compressed between the inner faces of the bodies.

BRIEF DESCRIPTION OF THE DRAWING

The above and other objects, features, and advantages will become more readily apparent from the following description, reference being made to the accompanying drawing in which:

FIG. 4 is a vertical section taken along line IV—IV of FIG. 7 through the connector piece;

FIG. 5 is a view taken in the direction of arrow V of FIG. 4;

FIG. 6 is a view taken in the direction of arrow VI of FIG. 5;

FIG. 7 is a view taken in the direction of arrow VII of FIG. 4;

FIG. 8 is a section taken along line VIII—VIII of FIG. 5;

FIG. 9 is a section taken along line IX—IX of FIG. 5;

SPECIFIC DESCRIPTION

Figure 1:
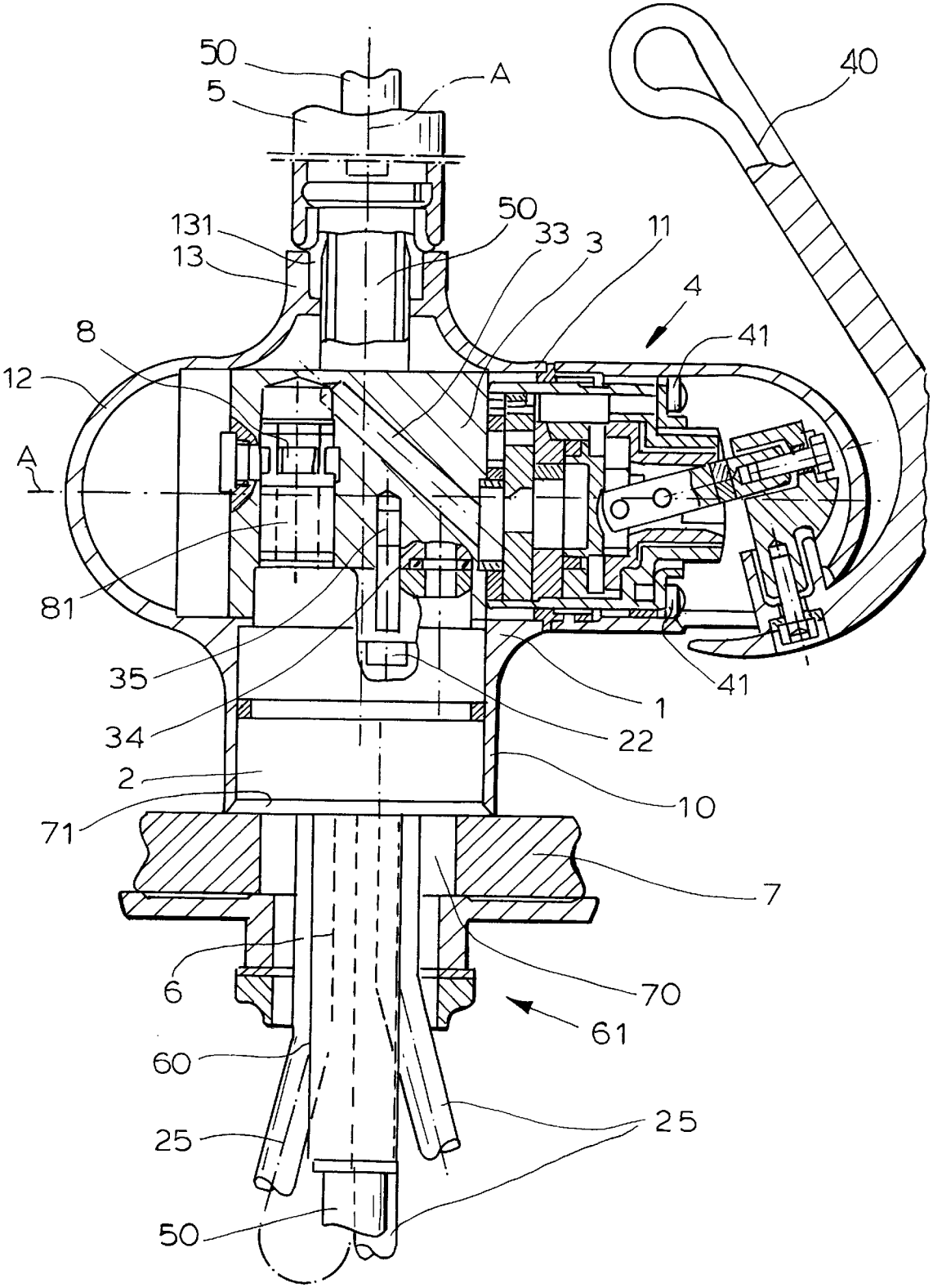
FIG. 1 is a side view partly in vertical section through the valve according to the invention.

As seen in FIG. 1 a mixing valve according to the invention basically has a hollow-cast steel housing 1, a brass insert body or piece 2, a brass connector body or piece 3, a valve cartridge 4, a guide and holding tube 5, and a mounting pipe 6.

Figure 2:
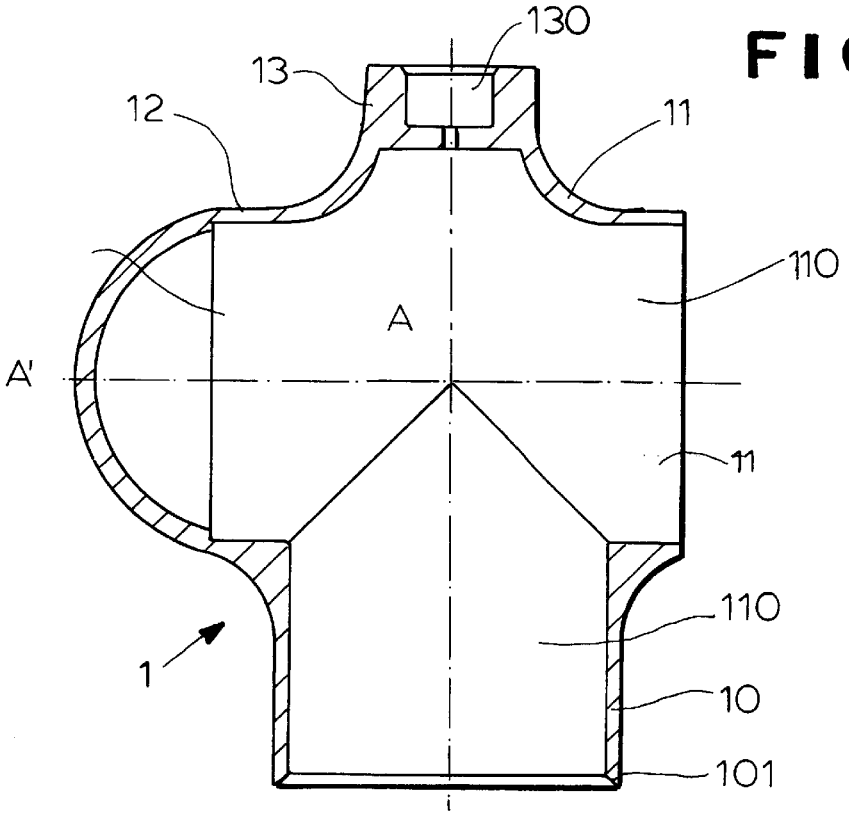
FIG. 2 is a vertical section taken along line II—II of FIG. 3 through the housing of the valve.
Figure 3:
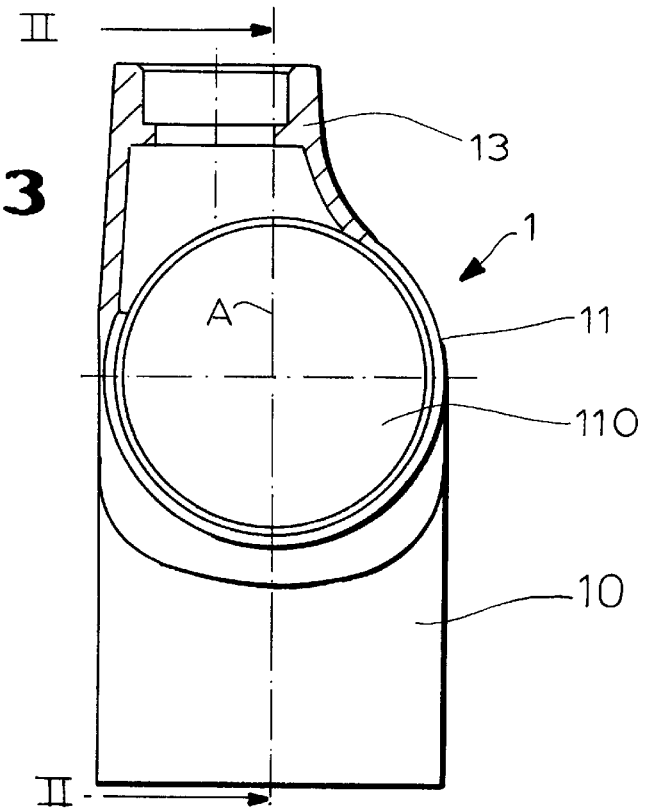
FIG. 3 is a side view partly in vertical section through the housing.

The housing 1 is formed as shown in FIGS. 2 and 3 with four cylindrical sockets 10, 11, 12, and 13 centered on a pair of crossing perpendicular axes A and A' normally lying in a vertical plane, with the seats 10 and 13 coaxial and the seats 11 and 12 coaxial. The sockets 10, 11, and 13 form respective cylindrical seats 100, 110, and 130 while the socket 12 is closed. In fact a connection can be made at the closed socket 12 for a valve and a dishwasher, for example.

Figure 11:
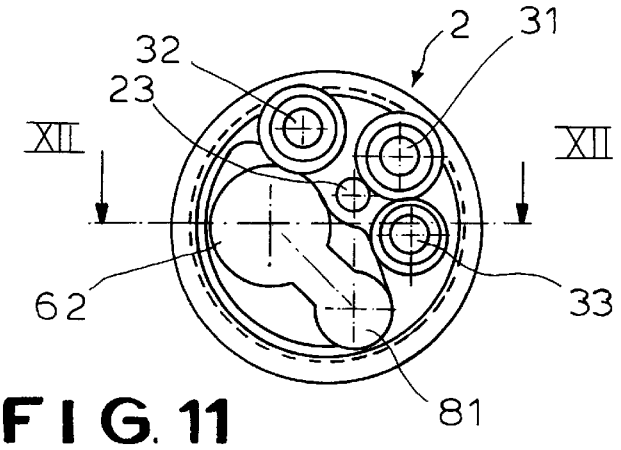
FIG. 11 is a bottom view taken in the direction of arrow XI of FIG. 10.
Figure 10:
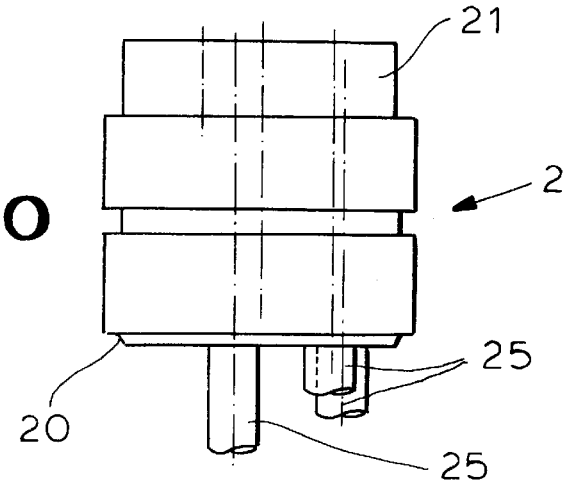
FIG. 10 is a side view of the insert piece in accordance with the invention.
Figure 12:
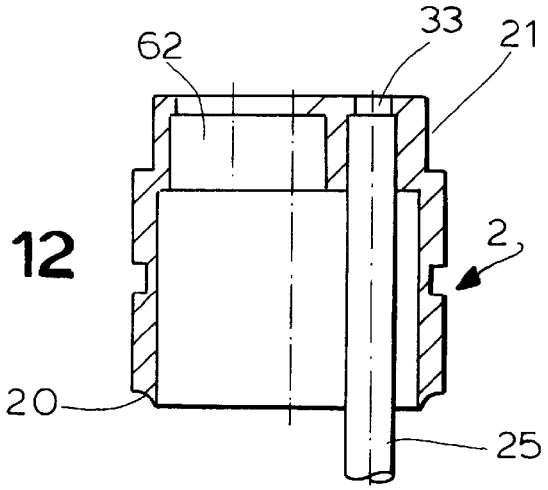
FIG. 12 is a section taken along line XII—XII of FIG. 11.

The connector body or piece 3 (FIGS. 4–9) is of basically cylindrical shape and fits in the coaxial sockets 11 and 12. It is formed with a laterally open cylindrically cup-shaped recess 30 in which a cylindrical end extension 21 of the insert body or piece 2 (FIGS. 10–12) fits. A screw 22 (FIG. 1) extends through an axially throughgoing counterbored passage 23 of the insert 2 and is threaded into a bore 35 of the connector 3 so as to lock these two pieces 2 and 3 together. Thus once the screw 22 is in place, the two pieces 2 and 3 are solidly captured in the housing 1 and cannot move relative to it.

The piece 3 is formed as best seen in FIG. 5 with a hot-water input passage 31, a cold-water input passage 32, and an output passage 33 for mixed water. The cartridge 4 is of standard construction with a pair of ceramic plates that can be shifted relative to one another to allow input from either or both of the passages 31 and 32 to be diverted to the passage 33. In order to secure the cartridge 4, the body 3 is formed with a pair of threaded holes 36 in which engage screws 41 traversing the cartridge 4. A handle 40 attached to the cartridge 4 can be tipped from front to back, about a horizontal axis perpendicular to the plane of the axes A and A', to control the volume of flow to the mixed-water passage 33, and from right to left about the axis A' to control the temperature of the water fed to the passage 33. The passages 31, 32, and 33 each open at one end at a front face 37 lying in a plane perpendicular to the axis A' and against which the cartridge 4 bears, and at a bottom face 38 lying in a plane perpendicular to the axis A and forming the floor of the recess 30. The passage 33 is provided with a tube aerator or vent 8 with a vent passage 81 extending parallel to the axis A and opening to the outside. Water enters this aerator 8 axially and leaves it radially and if there is a pressure reversal air will be sucked in through the passage 81.

A pair of input or feed tubes 25 each about 500 mm long are connected via the brass piece 2 to the passages 31 and 32 or may even extend through this piece 2 to fit in compression washers 34 compressed between the parts 2 and 3. These tubes 25 can be copper, in which case they can be soldered or brazed in place, or plastic. A flexible tube 50 has one end connected to the passage 33 to receive flow therefrom, then extends downward and loops back up to pass the pipe 6 so it can extend up through the tube 5. This tube 5 is typically arcuate and formed as a faucet spout while the end of the tube 50 is formed as a faucet head that can be pulled out to act as a sprayer.

The pipe 6 fixed in the body 2 has an external screw-thread 60 and extends downward through a hole 70 in a deck or counter 7 at which the vent passage 81 opens. A nut assembly 61 threaded onto this pipe 6 secures the housing 1 tightly down on the deck 7. A radially inwardly open groove 101 (FIG. 2) formed in the lower end of the socket 10 fits with a radially outwardly open groove 20 (FIG. 12) formed in the lower end of the body 2 to accept a seal ring 71 preventing any water from getting underneath the housing 1. This pipe 6 passes along the passages 62 through the bodies 2 and 3 and a nut 131 is threaded to its upper end and engages downward in the seat 13 to lock this pipe 6 to the housing 1, while this pipe 6 further locks the parts 2 and 3 in the housing 1.

The basic body of such a valve is assembled by first pushing the piece 3 in along the axis A' and then aligning its passage 62 with the axis A with the recess 32 pointing down in the socket 10. Then the piece 2 is inserted in the socket 20 with its extension 21 fitting into the recess 30 and the screw 34 is seated. The cartridge 4 is installed with the screws 41 and the pipe 6 is threaded through the passages 62 and secured in place with the nut 131 in the socket 13.

While the parts 1, 2, and 3 are here shown to be of metal, they can also be cast of a durable plastic. In addition it is possible to provide, instead of the mixing cartridge 4, separate hot- and cold-water valves for a dual control system, or even a single valve for controlling a single flow, with no mixing potential.

We claim:

1. A valve body comprising:

a hollow rigid housing formed with at least two outwardly open sockets centered on respective axes that extend generally perpendicularly of each other; p1 a connector body fitted in one of the sockets at an intersection of the axes and having an outer face directed outwardly in the one socket and an inner face directed outward in the other socket, the connector body being formed with a plurality of passages extending between the faces;

a valve cartridge secured to the connector-body outer face;

an insert body fitted in the other socket, having an inner face engaging complementarily with the connector-body inner face, and formed with passages having inner ends opening into the connector-body passages at the connector-body inner face and outer ends, one of the inner faces being formed as a recess and the other as a complementary projection such that when fitted together the connector body is fixed in the housing;

input lines connected to the outer ends of the insert-body passages; and means including a mounting element extending into the insert body for securing the bodies and housing to a plate.

2. The valve body defined in claim 1 wherein the one socket extends across the axis of the other socket.

3. The valve body defined in claim 1 wherein the other socket extends across the one socket and is outwardly open in two axially opposite directions.

4. The valve body defined in claim 3 wherein the mounting element extends through the housing and through both of the bodies and is provided with a nut bearing on the housing in one direction and another nut threaded on the mounting element and bearing in an opposite direction on the plate.

5. The valve body defined in claim 4 wherein the mounting element is a pipe and the body includes a flexible feed tube extending through the pipe.

6. The valve body defined in claim 4 wherein the housing is formed around the pipe with a groove and is provided in the groove with a seal ring bearing against the plate.

7. The valve body defined in claim 1 wherein the housing is of steel.

8. The valve body defined in claim 1 wherein the recess is formed in the connector-body inner face, the body further comprising a screw extending across the inner faces and having a head bearing on the insert body and a shank threaded in the connector body.

9. The valve body defined in claim 1, further comprising an aerator in one of the connector-body passages.

10. The valve body defined in claim 1 wherein the bodies are plastic.

11. The valve body defined in claim 1 wherein the passages are each provided with a seal ring that is compressed between the inner faces of the bodies.

* * * * *